US007007957B1

(12) United States Patent
Lee

(10) Patent No.: US 7,007,957 B1
(45) Date of Patent: Mar. 7, 2006

(54) WHEEL HOLDER ASSEMBLY FOR A SKATEBOARD

(76) Inventor: Guang-Gwo Lee, 10th Floor, No. 101, Suhg Road, Taipei (TW)

( * ) Notice: Subject to any disclaimer, the term of this patent is extended or adjusted under 35 U.S.C. 154(b) by 0 days.

(21) Appl. No.: 09/736,315

(22) Filed: Dec. 15, 2000

(51) Int. Cl.
*A63C 17/02* (2006.01)

(52) U.S. Cl. ..... 280/11.28; 280/87.042; 280/809

(58) Field of Classification Search ..... 280/87.041, 280/87.042, 87.043, 11.27, 11.28, 809, 11.19
See application file for complete search history.

(56) References Cited

U.S. PATENT DOCUMENTS 4,047,725 A * 9/1977 Pinchock ..... 280/11.28
4,071,256 A * 1/1978 Kimmell ..... 280/11.28
4,089,536 A * 5/1978 Larrucea ..... 280/11.28
4,251,087 A * 2/1981 Hansen ..... 280/11.28
4,311,319 A * 1/1982 Snyder et al. ..... 280/11.28
4,398,734 A * 8/1983 Barnard ..... 280/11.28
4,596,396 A * 6/1986 Merbler ..... 280/11.28
4,861,054 A * 8/1989 Spital ..... 280/221
4,896,893 A * 1/1990 Shumays et al. ..... 280/14.2
5,263,725 A * 11/1993 Gesmer et al. ..... 280/11.28
5,853,182 A * 12/1998 Finkle ..... 280/87.042
5,879,013 A * 3/1999 Shih ..... 280/11.28
6,182,987 B1 * 2/2001 Bryant ..... 280/87.042

* cited by examiner

*Primary Examiner*—Brian L. Johnson
*Assistant Examiner*—Bridget Avery
(74) *Attorney, Agent, or Firm*—Donald C. Casey

(57) ABSTRACT

A wheel holder assembly includes a mounting frame fixedly fastened to the footplate of a skateboard, a screw bolt mounted in the mounting frame, a hook plate mounted on the screw bolt and hooked on a barrel at the mounting frame, a swivel wheel holder frame mounted on the screw bolt to hold a pair of wheels, a first corrugated washer and a second corrugated washer mounted on said screw bolt and matched with each other between the hook plate and the wheel holder frame, the first corrugated washer having a locating groove engaged with a locating rib at the wheel holder frame for enabling the first corrugated washer to be turned with the wheel holder frame about the screw bolt relative to the second corrugated washer, and a compression spring mounted on the screw bolt to force the wheel holder frame against the first corrugated washer.

1 Claim, 6 Drawing Sheets

WHEEL HOLDER ASSEMBLY FOR A SKATEBOARD

BACKGROUND OF THE INVENTION

The present invention relates to skateboards and, more specifically, to a wheel holder assembly for skateboard, which supports the wheels stably, enabling the steering direction of the skateboard to be smoothly controlled.

Riding a skateboard has become one of the most hot sports game for young children. A skateboard is generally comprised of a footplate, and two wheel holder assemblies mounted on the bottom sidewall of the footplate to hold a respective pair of wheels. FIG. 1 illustrates a wheel holder assembly installed in the bottom sidewall of a footplate to hold a pair of wheels according to the prior art. This structure of wheel holder assembly comprises a mounting frame D fixedly fastened to the bottom sidewall of the footplate, a screw bolt C fastened to the mounting frame D, a wheel holder frame A pivoted to the screw bolt C, and two compression springs B respectively mounted on the screw bolt C and supported on top and bottom sides of the wheel holder frame A. This structure of wheel holder assembly is still not satisfactory in function. Because the compression springs are supported on the top and bottom sides of the wheel holder frame, they are frequently compressed and released and wear quickly with use. Further, because the compressive power of the compression spring cannot be relatively adjusted subject to the steering direction of the skateboard, the skateboard is less stable when changing the steering direction.

SUMMARY OF THE INVENTION

The present invention has been accomplished to provide a wheel holder assembly, which eliminates the aforesaid drawbacks. It is one object of the present invention to provide a wheel holder assembly, which is durable in use. It is another object of the present invention to provide a wheel holder assembly, which keeps the skateboard in a balanced status when changing the steering direction. According to the invention, the wheel holder assembly comprises a mounting frame fixedly fastened to the footplate of a skateboard, a screw bolt mounted in the mounting frame, a hook plate mounted on the screw bolt and hooked on a barrel at the mounting frame, a swivel wheel holder frame mounted on the screw bolt to hold a pair of wheels, a first corrugated washer and a second corrugated washer mounted on said screw bolt and matched with each other between the hook plate and the wheel holder frame, the first corrugated washer having a locating groove engaged with a locating rib at the wheel holder frame for enabling the first corrugated washer to be turned with the wheel holder frame about the screw bolt relative to the second corrugated washer, and a compression spring mounted on the screw bolt to force the wheel holder frame against the first corrugated washer. Because the compression spring is stopped at the front side of the wheel holder frame, it receives less pressure when the skateboard runs over an uneven road surface. Therefore, the compression spring does not wear quickly with use. Further, when the rider changes the steering direction of the skateboard, the first corrugated washer is moved with the wheel holder frame over the second corrugated washer to compress or release the compression spring.

DETAILED DESCRIPTION OF THE PREFERRED EMBODIMENT

Figure 1:
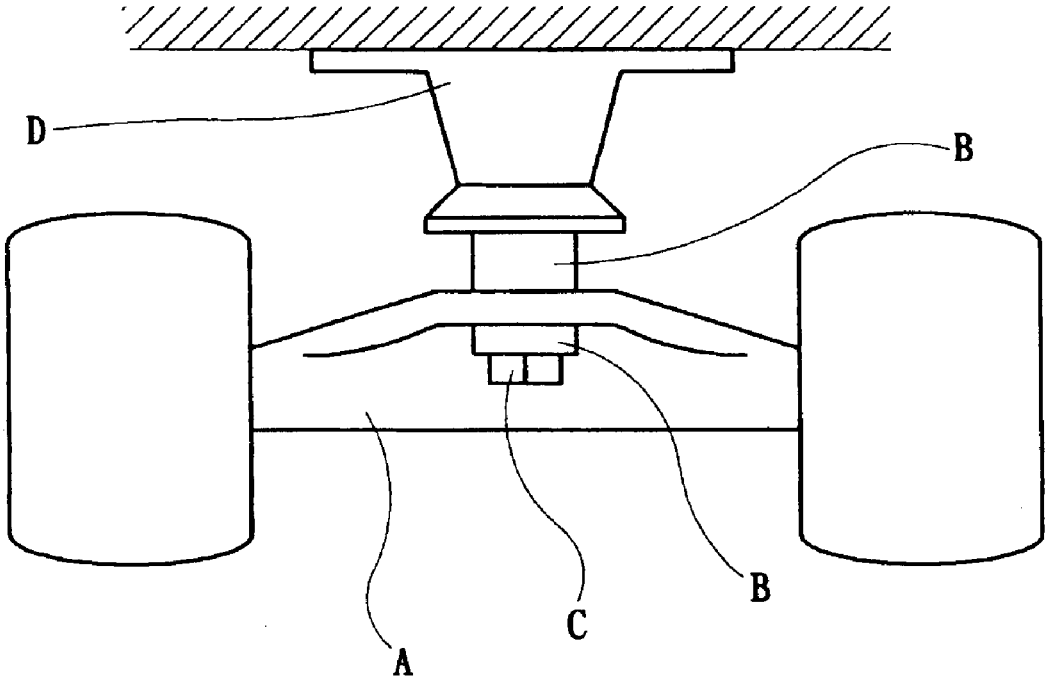
FIG. 1(PRIOR ART)
FIG. 1 illustrates a wheel holder assembly installed in a skateboard according to the prior art.
Figure 2:
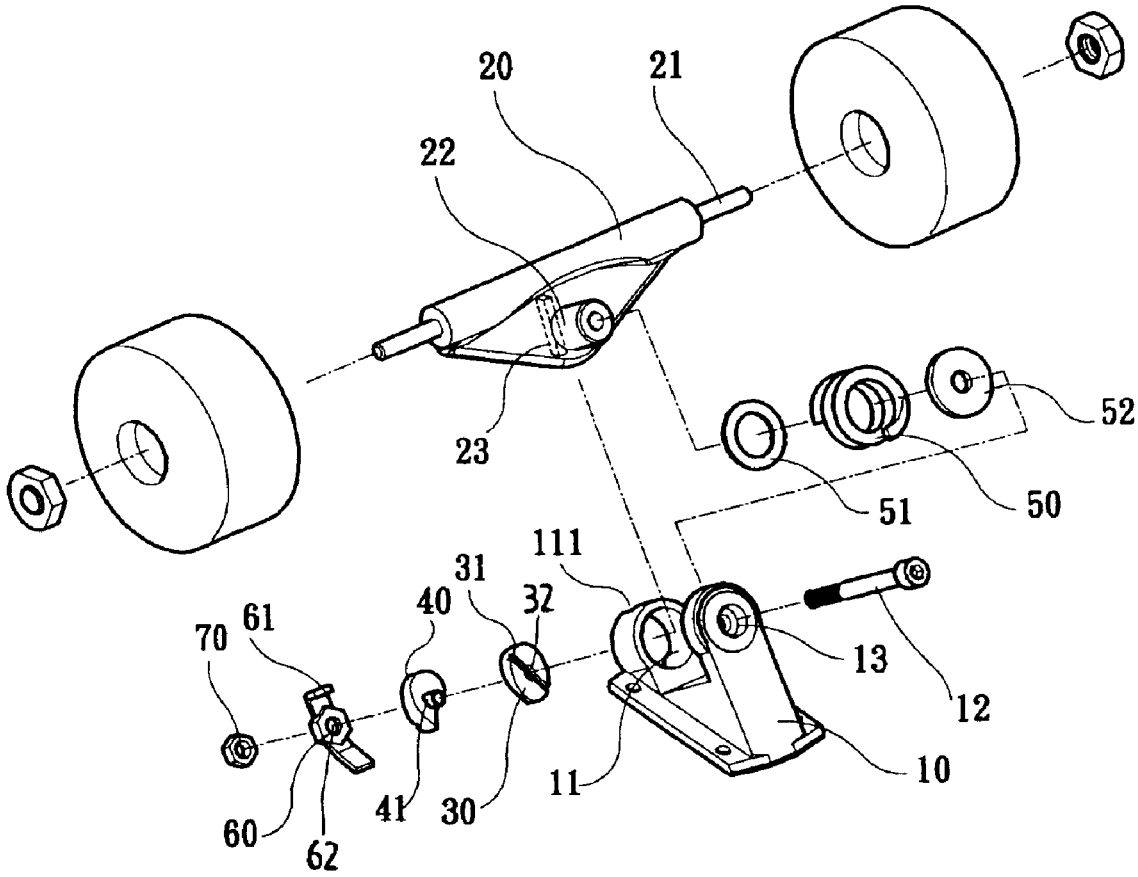
FIG. 2 is an exploded view of a wheel holder assembly according to the present invention.
Figure 3:
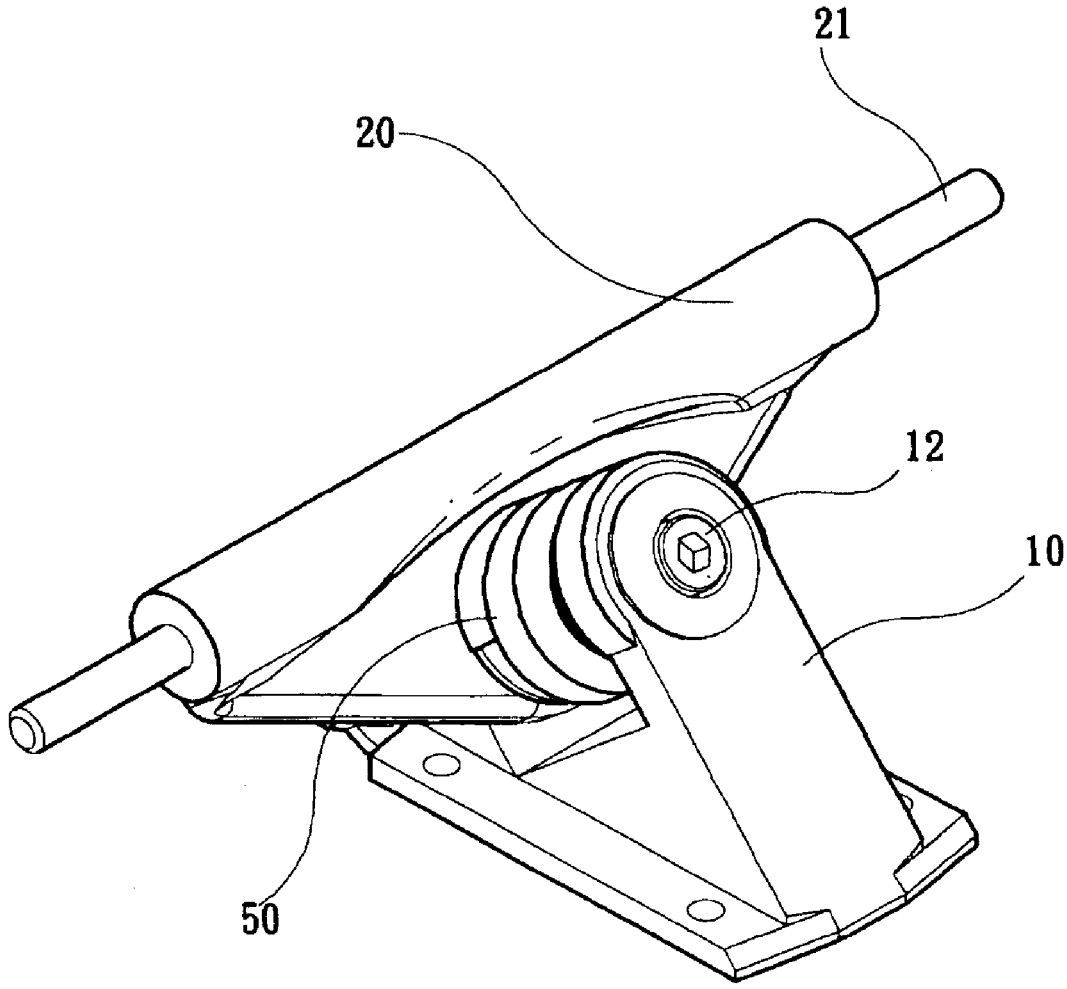
FIG. 3 is an elevational assembly view of the wheel holder assembly according to the present invention.

Referring to FIGS. 2 and 3, a wheel holder assembly in accordance with the present invention is generally comprised of a mounting frame 10, a screw bolt 12, a swivel wheel holder frame 20, a first corrugated washer 30, a second corrugated washer 40, a compression spring 50, a hook plate 60, and a lock nut 70. The mounting frame 10 is fixedly fastened to the bottom sidewall of the footplate of a skateboard (not shown), comprising a barrel 11 and a countersunk hole 13 spaced from and axially disposed in alignment with the barrel 11. The barrel 11 has a locating notch 111. The wheel holder frame 20 comprises two fixed wheel axles 21 axially aligned at two sides in a transverse direction with respect to the footplate and adapted to support a respective wheel, a pivot hole 22 extended in a longitudinal direction with respect to the footplate, and a locating rib 23 disposed at the back sidewall thereof and aligned at one sides of one end of the pivot hole 22. The first corrugated washer 30 comprises a center through hole 32, and a locating groove 31 disposed at one side across the center through hole 32. The second corrugated washer 40 matches the first corrugated washer 30, comprising a stub center tube 41 inserted through the center through hole of the first corrugated washer 30. The hook plate 60 is an elongated member comprising a center through hole 62, and a hooked head 61 at its one end.

Figure 4:
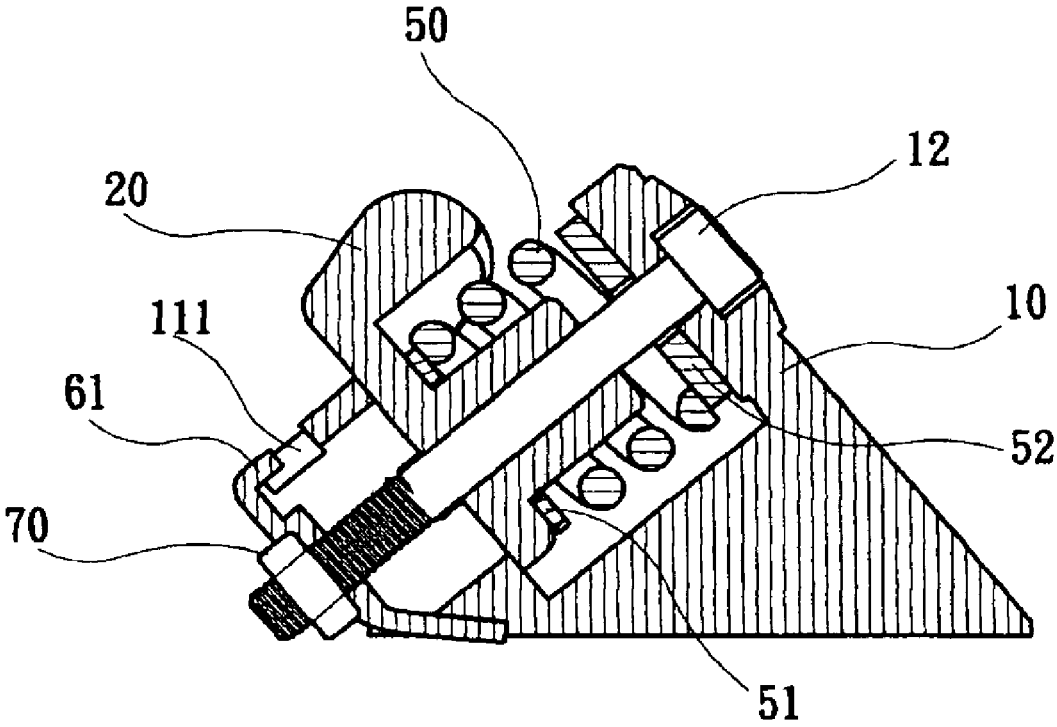
FIG. 4 is a sectional view of the wheel holder assembly according to the present invention excluding the corrugated washers.

Referring to FIG. 4 and FIGS. 2 and 3 again, the screw bolt 12 is mounted in the countersunk hole 13 and inserted in proper order through the center through hole 32 of the first corrugated washer 30 and the center stub tube 41 of the second washer 40 and the center through hole 62 of the hook plate 60 and then screwed up with the lock nut 70 to hold the corrugated washers 30 and 40 inside the barrel 11 of the mounting frame 10. The hook plate 60 is stopped between the barrel 11 and the locknut 70, having its hooked head 61 hooked on the locating notch 111 of the barrel 11. The compression spring 50 is mounted on the screw bolt 12 and stopped between the wheel holder frame 20 and the peripheral wall of the countersunk hole 13 of the mounting frame 10. Further, two washers 51 and 52 are mounted on the screw bolt 12, and respectively stopped between the countersunk hole 13 and the wheel holder frame 20 at two distal ends of the compression spring 50. When assembled, the locating ribs 23 of the wheel holder assembly 20 are maintained engaged with the locating groove 31 of the first corrugated washer 30.

Figure 5A:
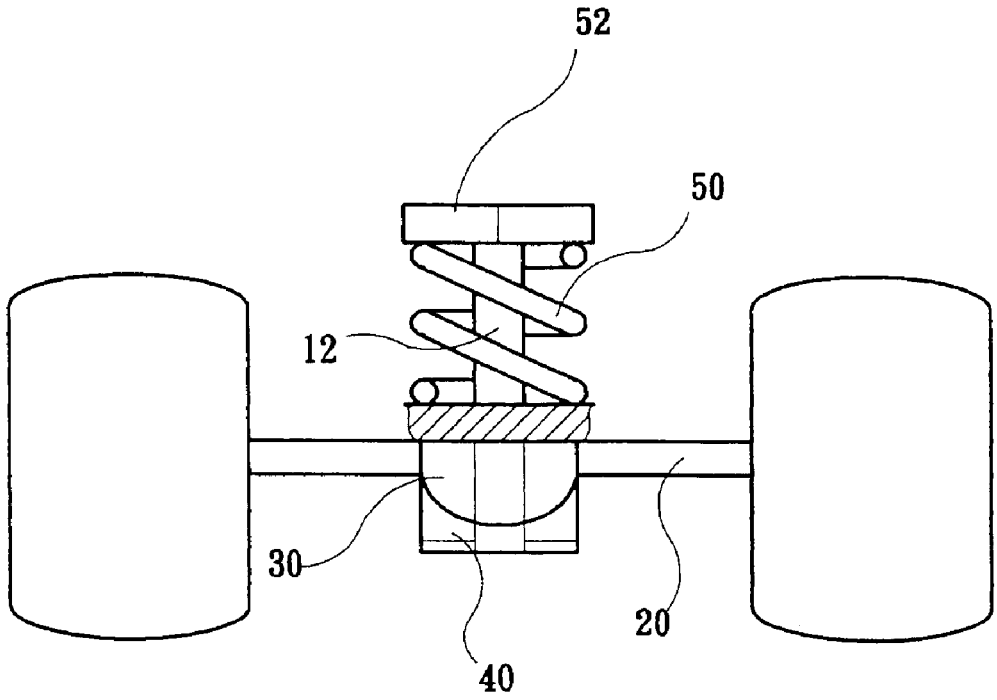
FIG. 5A illustrates the non-compressive status of the compression spring in the wheel holder assembly according to the present invention.
Figure 5B:
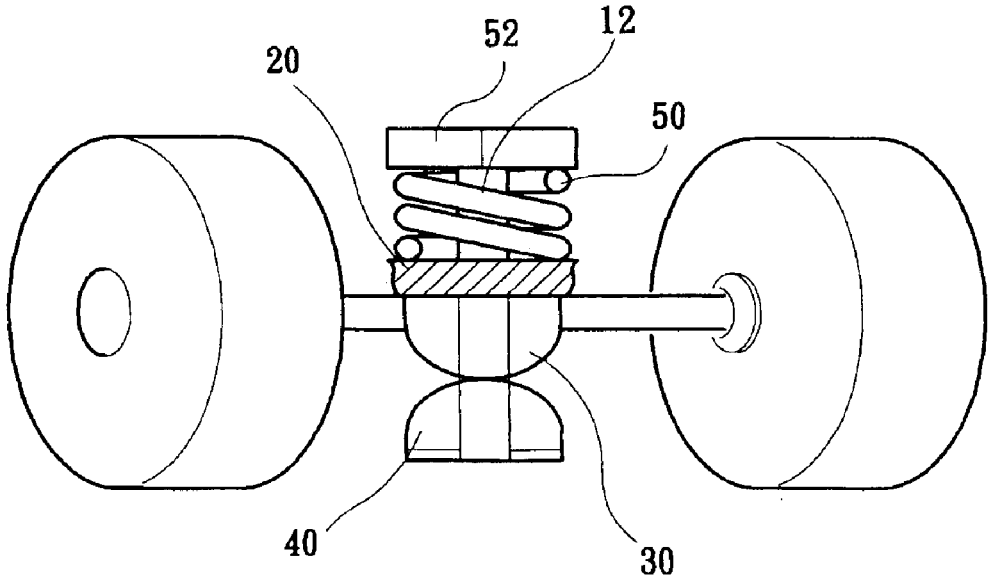
FIG. 5B illustrates the compressed status of the compression spring in the wheel holder assembly according to the present invention.
Figure 6:
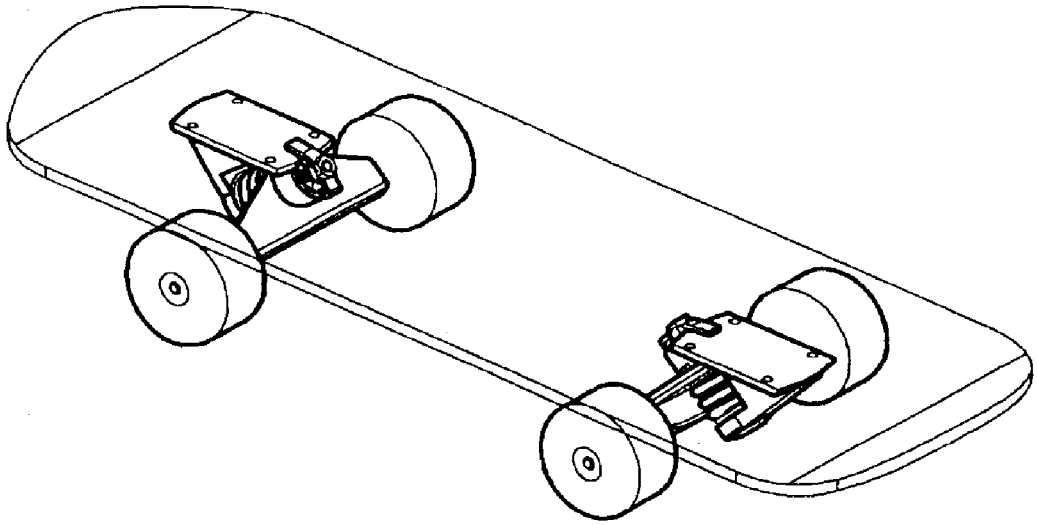
FIG. 6 shows the wheel holder assembly installed in the skateboard according to the present invention.

Referring to FIGS. 5A and 5B, when the rider gives a downward pressure to one lateral side of the skateboard to change the steering direction of the skateboard, the first corrugated washer 30 is rotated with the wheel holder frame 20 in one direction through one angle and moved over the second corrugated washer 40. When moving over the corrugated face of the second corrugated washer 40, the first corrugated washer 30 is forced to move the wheel holder frame 20 axially along the screw bolt 12 against the compression spring 50, thereby causing the compression spring 50 to be compressed. After the biased pressure disappeared, the compression spring 50 immediately returns to its former shape (returns from the compressed status shown in FIG. 5B to the non-compressive status shown in FIG. 5A) to push the wheel holder frame 20 back to its former position, enabling the skateboard to move straight ahead.

While only one embodiment of the present invention has been shown and described, it will be understood that various modifications and changes could be made thereunto without departing from the spirit and scope of the invention disclosed.

What the invention claimed is:

1. A wheel holder assembly installed in the footplate of a skateboard to hold a pair of wheels, comprising:

a mounting frame fixedly fastened to the footplate of the skateboard, said mounting frame comprising a barrel and a countersunk hole spaced from and axially aligned with said barrel, said barrel having a locating notch;

a screw bolt mounted in said countersunk hole of said mounting frame and extended through said barrel;

a locknut threaded onto said screw bolt;

a wheel holder frame pivoted to said screw bolt, said wheel holder frame comprising two fixed wheel axles axially aligned at two sides in a transverse direction with respect to the footplate and adapted to support a respective wheel, a pivot hole extended in a longitudinal direction with respect to the footplate and coupled to said screw bolt, and a locating rib disposed at a back sidewall thereof and aligned at one side of one end of said pivot hole;

a hook plate mounted on said screw bolt and stopped between said barrel and said locknut, said hook plate comprising a through hole coupled to said screw bolt and a hooked head hooked on the locating notch of said barrel;

a first corrugated washer mounted on said screw bolt and received inside said barrel between said wheel holder frame and said hook plate, said first corrugated washer comprising a center through hole coupled to said screw bolt, and a locating groove coupled to the locating rib of said wheel holder frame;

a second corrugated washer mounted on said screw bolt and received inside said barrel and supported between said hook plate and said first corrugated washer; and a compression spring mounted on said screw bolt and stopped between said countersunk hole and said wheel holder frame.

* * * * *